United States Patent [19]

Bayes et al.

[11] Patent Number: 5,060,809

[45] Date of Patent: Oct. 29, 1991

[54] DEVICE FOR HOLDING BAGS

[75] Inventors: Richard M. Bayes; Dennis B. Brashear, both of Duluth, Ga.

[73] Assignee: Tara Plastics Corporation, Forest Park, Ga.

[21] Appl. No.: 494,081

[22] Filed: Mar. 15, 1990

[51] Int. Cl.[5] ..... B42F 7/00

[52] U.S. Cl. ..... 211/59.1; 211/12; 248/95; 248/303

[58] Field of Search ..... 211/12, 59.1; 248/95, 248/97, 99, 302, 303, 304, 227

[56] References Cited

U.S. PATENT DOCUMENTS 4,724,967 2/1988 Valiulis ..... 211/59.1
4,762,299 8/1988 Langelier ..... 211/49.1 X
4,783,033 11/1988 Valiulis ..... 211/59.1 X
4,887,785 12/1989 Blaich ..... 248/304 X

FOREIGN PATENT DOCUMENTS 0278084 8/1988 European Pat. Off. ..... 248/304
0777254 6/1957 United Kingdom ..... 248/303

*Primary Examiner*—Ramon O. Ramirez
*Attorney, Agent, or Firm*—Needle & Rosenberg

[57] ABSTRACT

A device for holding a plurality of differently sized bags adjacent a mounting surface, each bag having at least one support hole, having a mounting bracket or a pair of mounting brackets, an elongated hinge member hingedly attached to the mounting bracket and a plurality of hooked members provided on the hinge member, each of the plurality of hooked members having an attachment flange or a pair of attachment flanges upon which a plurality of bags of a given size may be placed.

17 Claims, 3 Drawing Sheets

DEVICE FOR HOLDING BAGS

BACKGROUND OF THE INVENTION

The present invention relates to an improved device for holding bags, and particularly plastic or paper bags which are commonly found in retail establishments.

The vast majority of retail establishments supply bags to their customers for carrying their purchases from the stores. In the past, bags have been provided to the retailers in stacks, and the retailers have typically placed the bags in a cubby or some other compartment near the checkout counters. A problem existing with such loose packaging of bags is that the bags, and particularly plastic bags, tend to stick together and it is often time consuming for the person working at the counter to remove individual bags. Also, the bags tend to be pushed around and create a disorderly appearance behind the counter. To overcome this problem, it has been known to attach a large number of bags to a cardboard backing, so that the person at the checkout counter can simply pull a bag off of the pile when needed. However, again the problem of bags sticking to each other arises and cashiers spend a costly amount of time trying to separate the outermost bag from the remaining bags of the stack.

Another problem exists in that retailers typically house a number of differently sized bags under their counters. This is economical in that it does not waste materials by providing a large bag for a very small purchase. However, this causes problems in storing the number of different bags. Furthermore, it has been noted that cashiers will typically grab the closest bag to them regardless of size, and this often results in defeating the purpose of having multiple sized bags.

Therefore, there exists a need for a device which will hold bags in an orderly fashion and which will allow a counter person to remove a single bag quickly and efficiently.

There exists a further need for a device which allows an assortment of differently sized bags to be stored in an orderly fashion and which will encourage a cashier, counter person or otherwise to select the correct sized bag for the purchase.

SUMMARY OF THE INVENTION

The present invention includes means for efficiently holding and separating a plurality of bags and for holding differently sized bags in an orderly and convenient manner.

A first embodiment of the present invention for hanging multiple sized bags includes a mounting bracket, a U-shaped hinge member hingedly attached to the mounting bracket, and a plurality of hooked members provided along the length of the hinge member with each hooked member extending in an alternating manner from different sides of the hinge member. The hooked members each include an attachment bar disposed against the hinge member, an angled intermediate bar extending approximately perpendicular to the attachment bar, a vertically oriented intermediate bar extending downward from the angled intermediate bar, and an upwardly extending distal end which acts as an attachment flange. Each of the bags has a support hole located near the midportion of the top of the bag that will engage with an attachment flange.

Another embodiment of the present invention includes a pair of mounting brackets, an approximately U-shaped hinge member hingedly attached to the mounting brackets, and a plurality of hooked members provided along the length of the hinge member. The hooked members, except for an optional hooked member provided at the bottom of the "U" of the hinge member, each include an attachment bar extending across both arms of the hinge member, a pair of angled intermediate bars, a pair of vertically oriented intermediate bars, and a pair of upwardly extending distal ends which act as attachment flanges. Each of the bags preferably has a pair of support holes located in the upper right-hand and upper left-hand corners that will engage with the attachment flanges. The lowest hooked member may include only a single attachment flange, for supporting small bags having a single support hole located near the midportion of the top of the bag.

It is an object of the present invention to provide a device which will hold a bag in an orderly fashion and which will allow a counter person to remove a single bag quickly and efficiently.

It is another object of the present invention to provide a device which allows an assortment of differently sized bags to be stored in an orderly fashion and which will encourage cashier, counter person or otherwise to select the correct sized bag for the purchase.

DETAILED DESCRIPTION OF THE DRAWINGS

DETAILED DESCRIPTION OF THE INVENTION

Figure 1:
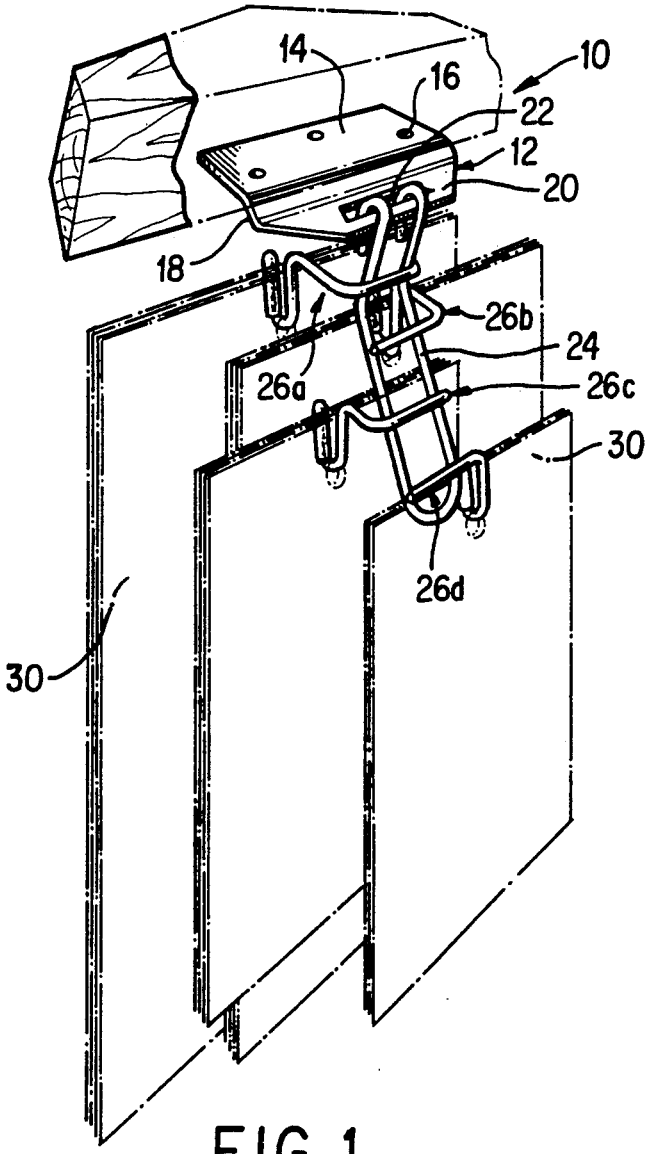
FIG. 1 is a perspective view of a first embodiment of the present invention for holding multiple sized bags.

FIGS. 1–4 show a first embodiment of the present invention. This device 10 will hold a plurality of bags 30 of different sizes which encourages the cashier or other counter person to select appropriately sized bags 30. Each of the plurality of bags 30 preferably has a hole 32 in its lateral midportion adjacent its top end.

The device 10 preferably includes a mounting bracket 12 comprising an attachment surface 14, an angled member 18 extending downwardly from one end of the attachment surface 14 and a supporting surface 20 at the other end of the angled member 18 lying in a plane corresponding to that of the attachment surface 14. The bracket 12 is preferably made of a strong metal material, and has mounting holes 16 in its attachment surface 14 for receiving screws or other attachment means for attaching the bracket 12 to a surface adjacent the cashier or counter person. The supporting surface 20 has a cavity 22 provided in its approximate midportion.

An elongated, U-shaped hinge member 24 has looped distal ends 25 and 27. The looped distal ends 25 and 27 are provided within the cavity 22 and are bent so as to hingedly interlock the hinge member 24 to the supporting surface 20.

Figure 3:
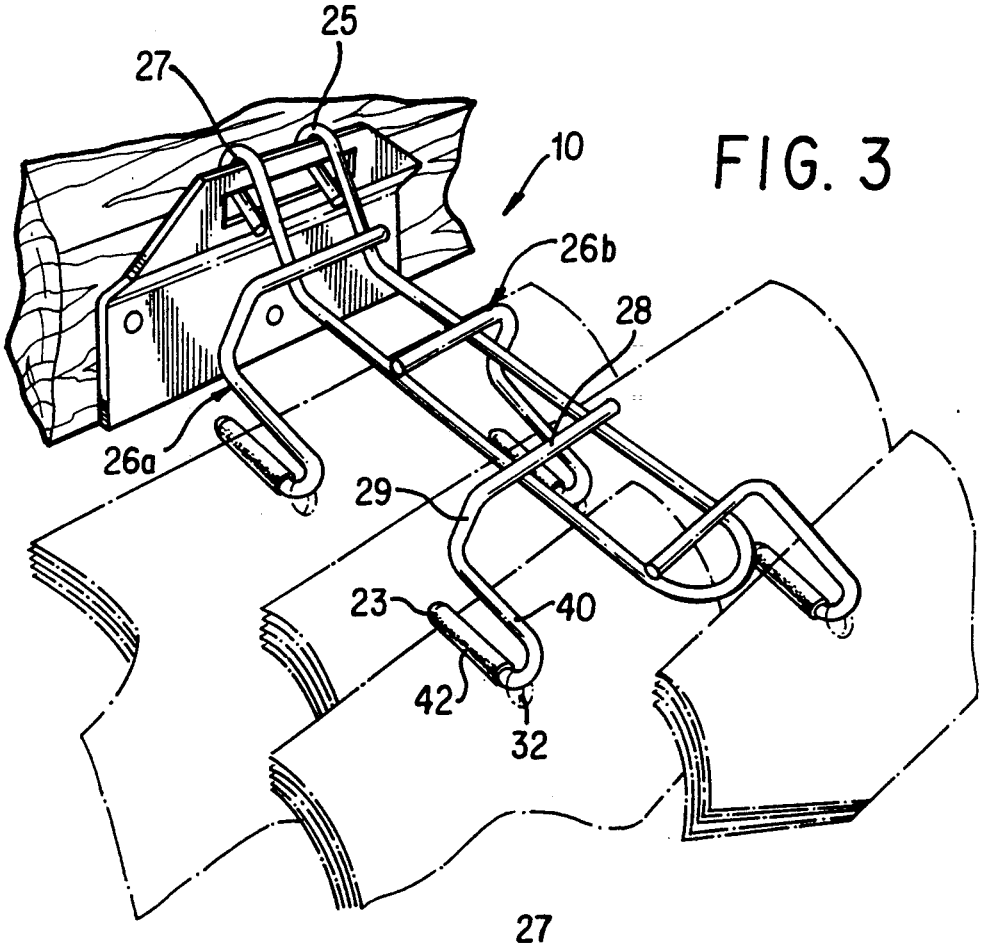
FIG. 3 is a perspective view of the first embodiment of the present invention as shown in FIG. 1, where the device is attached to a vertically oriented surface.
Figure 4:
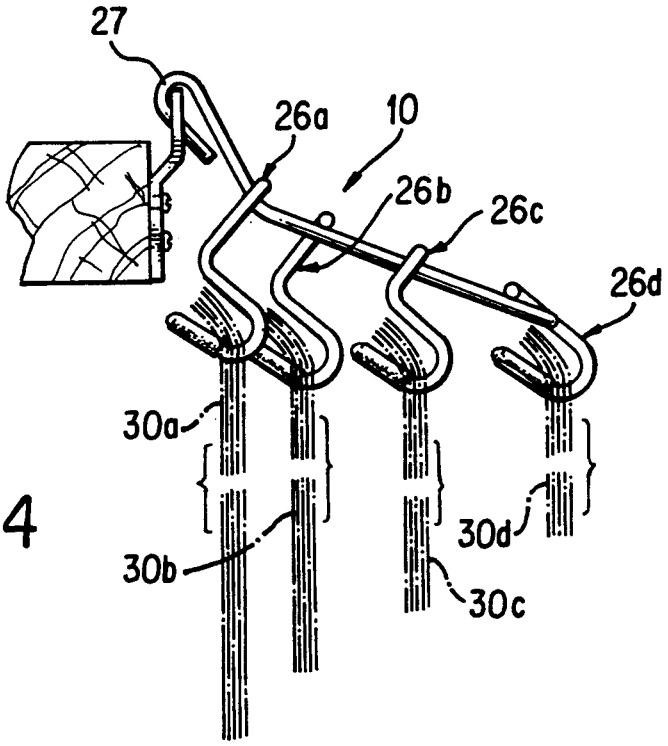
FIG. 4 is a side view of the first embodiment of the present invention as shown in FIG. 3.

A plurality of hooked members 26 are provided along the length of the hinge member 24. As best shown in FIG. 3, each of the hooked members 26 is comprised of an attachment bar 28, an angled intermediate bar 29, a vertically oriented intermediate bar 40 and an upwardly extending attachment flange or distal end 42. The distal end 42 may have a cover 23 thereon. A first hooked member 26*a* is attached to the hinge member 24 by attaching the attachment bar 28 to each of the arms of the hinge member 24. In this way, the distal end 42 will extend from one side of the U-shaped hinge member 24 in a direction toward the mounting bracket 12. A second hooked member 26*b* may be similarly provided, preferably having its distal end 42 extending from a side of the hinge member 24 opposite that from which the distal end 42 of the first hooked member 26*a* extends. A plurality of hooked members 26 may also be provided along the length of the hinge member 24, each extending in an alternating manner from different sides of the hinge member 24.

Figure 2:
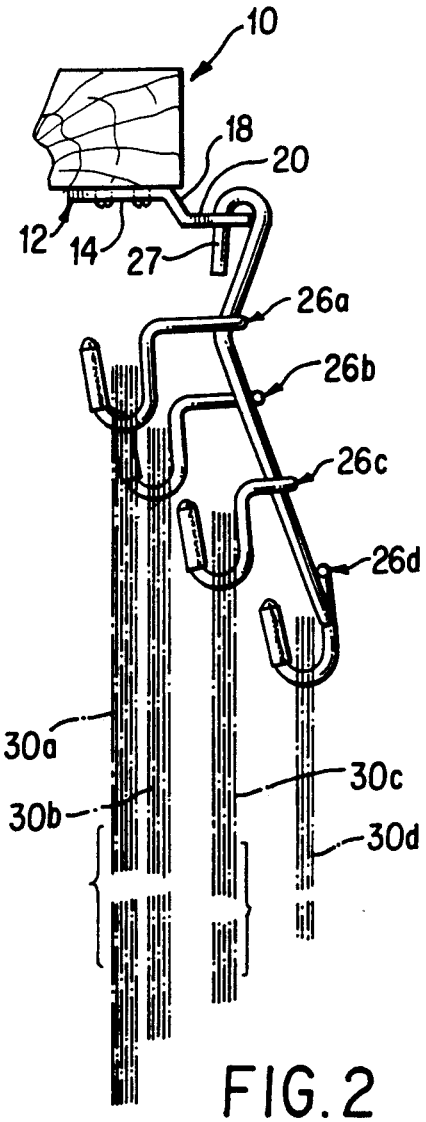
FIG. 2 is a side view of the first embodiment of the present invention as shown in FIG. 1, where the device is attached to a horizontally oriented surface.

In operation, the mounting bracket 12 is attached to a work surface such as a counter. In one embodiment, such as shown in FIG. 2, the mounting bracket 12 may be attached to the bottom of a counter by means of screws placed through the mounting holes 16. In this manner, the supporting surface 20 will extend from beyond the counter in a plane horizontal to that of the counter, and the hinge member 24 will be positioned in a somewhat downwardly direction. The hooked members 26 will therefore be placed so that the distal ends 42 extend upwardly towards the bottom of the counter. In this manner, a large bag 30*a* may be placed over the first hooked member 26*a*, a second bag 30*b*, smaller than the large bag 30*a*, may be placed over the second hooked member 26*b*, a third bag 30*c*, smaller than the second bag 30*b*, may be placed over a third hooked member 26*c*, and a fourth bag 30*d*, smaller than bags 30*a*, 30*b*, and 30*c*, may be placed over the bottom-most hooked member 26*d*. As can be seen in the figures, the bags 30 will be separated according to size, each will be visible to the cashier, and then each will have a surface capable of being reached without having to move one of the other sized bags 30. Such an arrangement results in all the bags 30 being equally accessible to the counter person.

In an alternate attachment mode, shown in FIG. 3, the mounting bracket 12 may be attached to a vertically oriented surface. In such a case, the hinge member 24 and the distal end 42 lie at an angle relative to the plane of the mounting bracket 12. Bags 30 may be placed on the hooked members 26 as described above, and will be accessible as stated above.

Figure 6:
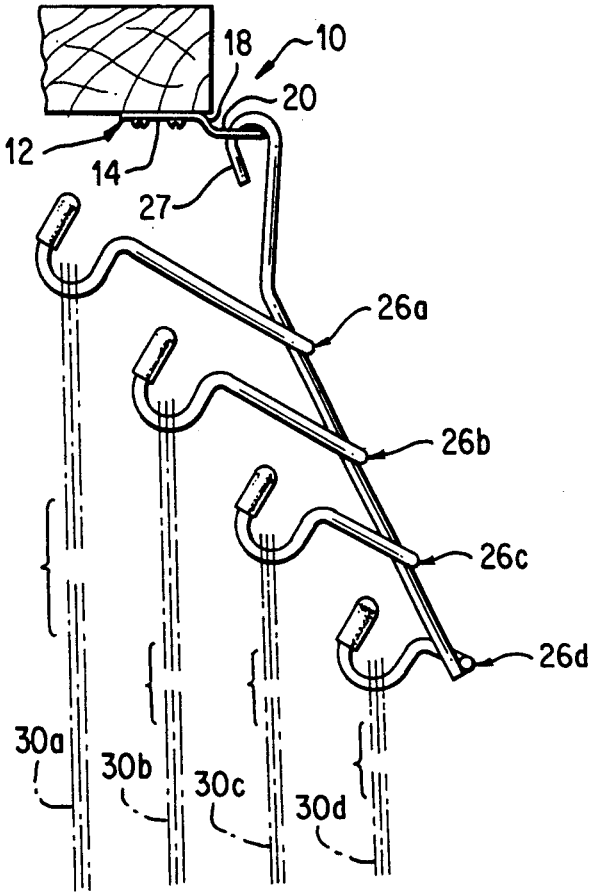
FIG. 6 is a side view of the second embodiment of the present invention as shown in FIG. 5.
Figure 5:
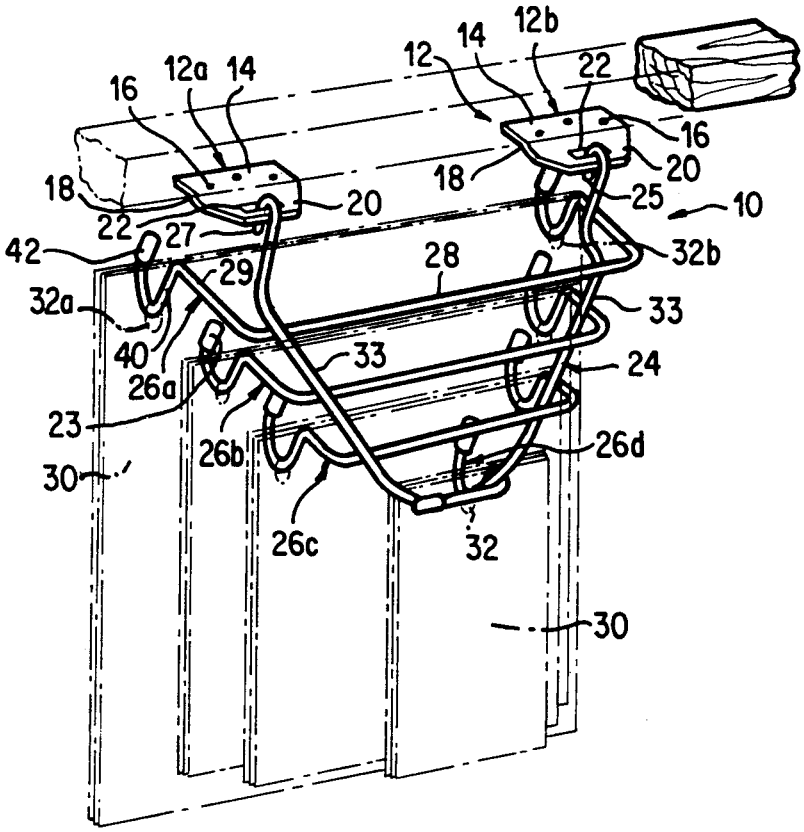
FIG. 5 is a perspective view of a second embodiment of the present invention for holding multiple sized bags.

A second embodiment of the present invention is shown in FIGS. 5 and 6. The device 10 will hold a plurality of bags 30 of different sizes. Each of the plurality of bags 30 includes a pair of holes 32*a* and 32*b* at the top left-hand and right-hand corners of the bags 30. The smallest sized bag 30, however, may only include one hole 32 in its lateral midportion adjacent its top end.

This embodiment includes a pair of mounting brackets 12*a* and 12*b*, each comprising an attachment surface 14, an angled member 18 extending downwardly from one end of the attachment surface 14 and a supporting surface 20 at the other end of the angled member 18 lying in a plane corresponding to that of the attachment surface 14. Each bracket 12*a* and 12*b* has mounting holes 16 in its attachment surface 14 for receiving screws or other attachment devices for attaching the brackets 12*a* and 12*b* to a surface adjacent the cashier or counter person. Each supporting surface 20 has a cavity 22 provided in its approximate midportion.

The approximately U-shaped hinge member 24 has a pair of arms 33 and is shaped such that each arm 33 of the hinge member 24 angles outward such that the looped distal ends 25 and 27 are spaced the farthest apart of any other corresponding points on the hinge member 24. The looped distal ends 25 and 27 are provided within the cavities 22.

As with the first embodiment, a plurality of hooked members 26 are provided along the length of the hinge member 24. Each of the hooked members 26 includes an attachment bar 28 extending across both arms of the hinge member 24, a pair of angled intermediate bars 29, a pair of vertically oriented intermediate bars 40 and a pair of upwardly extending attachment flanges or distal ends 42. The distal ends 42 will extend from opposite sides of the hinge member 24 in a direction toward the mounting brackets 12*a* and 12*b*. If a hooked member 26 is provided at the bottom of the "U" of the hinged member 24, such a hooked member will preferably only include one attachment flange or distal end 42.

In operation, the mounting brackets 12*a* and 12*b* are attached to a work surface such as a counter, as shown in FIG. 6. The mounting brackets 12*a* and 12*b* may be either vertically or horizontally oriented to the work surface. The hooked members 26 will be placed so that the distal ends 42 extend upwardly towards the bottom of the counter. In this embodiment, the larger bags 30 have a pair of holes 32*a* and 32*b* which correspond to the spacing of the pair of distal ends 42 of each hooked member 26. This arrangement allows for more support for each bag 30, since the weight of the bags 30 is distributed across the entire hooked member 26. The smallest sized bags 30, if desired, can be placed over the single distal end 42 of hooked member 26*d* located at the bottom of the "U".

In either embodiment, it may be seen that the bag is held behind small bags. Therefore, the counter person is forced to reach beyond the smaller bags to a larger bag. This requirement will encourage the counter person to select the smallest possible bag appropriate for the item.

While the above description contains many specificities, these should not be construed as limitations on the scope of the invention but rather as an application of preferred embodiments thereof.

What is claimed is:

1. A device for holding a plurality of differently sized bags adjacent a mounting surface, each bag having at least one support hole, comprising:

(a) a mounting bracket;

(b) an elongated hinge member hingedly attached to said mounting bracket; and (c) a plurality of hooked members provided on said hinge member, each of said plurality of hooked members having at least one attachment flange extending from one side of said hinge member and wherein each of said hooked members has an attachment flange disposed from the side of the hinge opposite that of its adjacent hooked member.

2. The device of claim 1, wherein said attachment flange of each of said plurality of hooked members is capable of holding each of said plurality of differently sized bags by the support hole of each bag.

3. The device of claim 1, wherein said hinge member is a U-shaped bar hingedly attached at its distal ends to said mounting bracket.

4. The device of claim 3, wherein said mounting bracket has a cavity and said distal ends of said hinge member are interlocked around said cavity to hingedly attach said hinge member to said mounting bracket.

5. The device of claim 1, wherein each of said plurality of hooked members includes an attachment bar provided on said hinge member, an angled intermediate bar extending approximately perpendicular to and integral with said attachment bar, and a vertically oriented intermediate bar extending approximately perpendicularly downward from and integral with said angled intermediate bar and integral with said attachment flange.

6. The device of claim 1, wherein said attachment flange comprises the distal end of said hooked member.

7. The device of claim 1, wherein each of said plurality of hooked members is a bar.

8. A device for holding a plurality of differently sized bags adjacent a mounting surface, each bag having at least one support hole, comprising:

(a) a pair of mounting brackets;

(b) an elongated hinge member hingedly attached to said mounting brackets; and (c) a plurality of hooked members provided on said hinge member, each of said plurality of hooked members having a pair of attachment flanges, upon which a plurality of bags of a given size may be placed.

9. The device of claim 8, wherein the pairs of attachment flanges closest to the mounting bracket are spaced further apart than those farther from the mounting bracket.

10. The device of claim 8, wherein said hinge member is an approximately U-shaped bar hingedly attached at its distal ends to said pair of mounting brackets, and further wherein said hinge member includes a pair of arms extending angularly outward such that its distal ends are spaced farther apart than any other corresponding points of said hinge member.

11. The device of claim 10, wherein each of said pair of mounting brackets has a cavity corresponding to said distal ends of said hinge member, and wherein said corresponding distal ends are interlocked around said cavity of said corresponding mounting bracket to hingedly attach said hinge member to said mounting brackets.

12. The device of claim 8, wherein each of said plurality of hooked members includes an attachment bar extending across both sides of said hinge member, a pair of angled intermediate bars extending approximately perpendicular to and integral with said attachment bar, and a pair of vertically oriented intermediate bars extending approximately perpendicularly downward from and integral with said pair of angled intermediate bars and integral with said pair of attachment flanges.

13. The device of claim 8, wherein said pair of attachment flanges comprise the distal ends of said hooked member.

14. The device of claim 8, wherein each of said plurality of hooked members is a bar.

15. The device of claim 8, wherein said pair of attachment flanges of each of said plurality of hooked members holds each of the plurality of differently sized bags, having two support holes by the support holes of each bag.

16. The device of claim 8, further comprising a hooked member provided at the bottom of said hinge member, wherein said hooked member includes one attachment flange.

17. The device of claim 16, wherein said attachment flange of said hooked member provided at the bottom of said hinge member holds said bags having one support hole by the support hole of each bag.

* * * * *